US007219889B2

(12) United States Patent
Hachmann et al.

(10) Patent No.: US 7,219,889 B2
(45) Date of Patent: May 22, 2007

(54) SHEET-PROCESSING MACHINE WITH A PNEUMATIC SHEET-GUIDING DEVICE

(75) Inventors: Peter Hachmann, Dossenheim (DE); Christian Hieb, Neuhofen (DE); Sven Kerpe, Eggenstein-Leopoldshafen (DE); Günter Stephan, Wiesloch (DE); Ralf Weiser, Ladenburg (DE); Thorsten Eckart, Ilvesheim (DE); Karl-Heinz Helmstädter, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 210 days.

(21) Appl. No.: 10/689,973

(22) Filed: Oct. 21, 2003

(65) Prior Publication Data

US 2004/0080102 A1 Apr. 29, 2004

(30) Foreign Application Priority Data

Oct. 21, 2002 (DE) ..... 102 48 973
May 23, 2003 (DE) ..... 103 23 468

(51) Int. Cl.
*B65H 5/00* (2006.01)

(52) U.S. Cl. ..... 271/264; 271/194

(58) Field of Classification Search ..... 271/264, 271/194, 195; 101/420, 232, 416.1, 419
See application file for complete search history.

(56) References Cited

U.S. PATENT DOCUMENTS 3,779,545 A * 12/1973 Schuhmann et al. ..... 271/183
4,165,132 A * 8/1979 Hassan et al. ..... 406/10
5,222,726 A * 6/1993 Vits ..... 271/195
5,634,636 A * 6/1997 Jackson et al. ..... 271/225
5,730,055 A 3/1998 Döpke et al.
5,803,448 A 9/1998 Stiel et al.
5,988,633 A * 11/1999 Henn et al. ..... 271/204
6,038,998 A * 3/2000 Platsch ..... 118/46
6,269,743 B1 * 8/2001 DeMoore et al. ..... 101/420
6,361,041 B2 * 3/2002 Stephan ..... 271/195
6,454,260 B1 * 9/2002 Noolandi et al. ..... 273/108
6,457,409 B2 * 10/2002 Fujimoto ..... 101/232
6,477,951 B2 * 11/2002 Fujimoto ..... 101/232
2001/0011509 A1 * 8/2001 Fujimoto ..... 101/232
2001/0038177 A1 * 11/2001 Spurk ..... 271/195
2002/0078842 A1 * 6/2002 Frankenberger et al. .... 101/232

FOREIGN PATENT DOCUMENTS

DE 41 41 261 A1 6/1993
DE 44 06 847 A1 9/1995
DE 19733691 * 6/1998
JP 10-109404 * 4/1998

* cited by examiner

*Primary Examiner*—Patrick Mackey
*Assistant Examiner*—Thomas Morrison
(74) *Attorney, Agent, or Firm*—Laurence A. Greenberg; Werner H. Stemer; Ralph E. Locher

(57) ABSTRACT

A sheet-processing machine, particularly a rotary printing press, includes a blast-air supply system and a pneumatic sheet-guiding device connected thereto. The sheet-guiding device has a sheet-guiding surface formed with air passage openings and serves for having the sheets dragged thereover in a sheet travel direction. The air passage openings serve for expelling sheet-carrying air flows during operation. The sheet-guiding device further includes flow ducts for aligning sheet-carrying air flows. The air passage openings in the sheet guiding surface form opening cross-sections of the flow ducts in the form of slots having a length which is many times greater than the width thereof.

16 Claims, 8 Drawing Sheets

SHEET-PROCESSING MACHINE WITH A PNEUMATIC SHEET-GUIDING DEVICE

BACKGROUND OF THE INVENTION

Field of the Invention

The invention relates to a sheet-processing machine, in particular a rotary printing press, having a blast or blown-air supply system and a pneumatic sheet-guiding device connected thereto. The sheet-guiding device has a sheet-guiding surface formed with air passage openings and serving for having the sheets dragged thereover in a sheet travel direction. The air passage openings serve for expelling sheet-carrying air flows during operation.

The sheet-guiding surface of the aforementioned sheet-guiding device is understood to mean a surface which is straight transversely to the sheet travel direction and, in the sheet travel direction, depending upon the location at which the sheet-guiding device is applied, is straight or curved or has straight and curved sections.

Heretofore-known pneumatic sheet-guiding devices have air passage openings distributed over the guiding surface in accordance with a very great variety of ordering principles. It is intended that, with the configuration of the air passage openings, the quietest possible, i.e., flutter-free, travel of the sheets being dragged over the guiding surface on an air cushion should always be effected. In this regard, the air cushion means an air cushion which serves for floatingly guiding, in accordance with the aerodynamic paradox, a sheet dragged over the guiding surface at spaced distances from the guiding surface which are dependent upon the pressure distribution over the guiding surface and the weight per unit area of the sheets.

As has become known heretofore, for example from German Published, Non-Prosecuted Patent Application DE 44 06 847 A1, corresponding to U.S. Pat. No. 5,803,448, the air passage openings form openings of individual nozzles, which are distributed in a particularly aligned manner over the guiding surface. Regardless of the configuration and alignment thereof, nozzles distributed over the guiding surface and through which flow takes place out of the guiding surface during operation, in principle, effect a pressure distribution between the surface and a sheet dragged over the latter. The pressure distribution depends upon the configuration of the nozzles but is always typical to this extent because a negative pressure or an at least relatively small positive pressure is established in the immediate region of a respective nozzle, and a positive pressure is established in a region disposed downstream with respect to the respective flow direction. This has an effect upon the sheet drawn over the guide surface which is that the floating height thereof is different at different locations on the guiding surface. Therefore, peaks and troughs are formed on the sheet which are distributed thereover and propagated along the sheet in the direction opposite to the dragging direction. In this way, fluttering movements are forced upon the sheet which, in particular, in a recto/verso printing process, can lead to the damaging of a printed image on the sheet due to smearing.

SUMMARY OF THE INVENTION

It is accordingly an object of the invention to provide a sheet-processing machine with a pneumatic guiding device, which overcomes the hereinafore-mentioned disadvantages of the heretofore-known devices of this general type so that it does not have a disruptive effect upon a smooth sheet travel or run.

With the foregoing and other objects in view, there is provided, in accordance with the invention, a sheet-processing machine, particularly a rotary printing press, comprising a blast or blown-air supply system and a pneumatic sheet-guiding device connected thereto. The sheet-guiding device has a sheet-guiding surface formed with air passage openings and serving for having the sheets dragged thereover in a sheet travel direction. The air passage openings serve for expelling sheet-carrying air flows during operation. The sheet-guiding device has flow ducts aligning the sheet-carrying air flows. The air passage openings in the sheet-guiding surface form opening cross-sections of the flow ducts in the form of slots having a length which is many times greater than the width thereof.

In accordance with another feature of the invention, the machine further includes guide vanes provided in the flow ducts.

In accordance with a further feature of the invention, the slots are disposed symmetrically with respect to a line of symmetry.

In accordance with an added feature of the invention, the air passage openings include waste-air openings assigned to the slots.

In accordance with an additional feature of the invention, the waste-air openings form waste-air slots.

In accordance with yet another feature of the invention, the waste-air openings, on a side of the sheet-guiding device facing away from the sheet-guiding surface, are in communication with the atmosphere.

In accordance with yet a further feature of the invention, the machine further includes a vacuum generator for acting upon the waste-air openings.

In accordance with yet an added feature of the invention, the air passage openings include purging air openings for discharging purging air flows. The purging air openings are disposed in regions wherein the sheet-carrying air flows produce a vacuum when purging air flows are lacking.

In accordance with yet an additional feature of the invention, the air passage openings include supporting-air openings for discharging supporting air flows. The supporting-air openings are disposed in regions wherein the sheet-carrying air flows produce maximum vacuum when supporting air flows are lacking.

In accordance with another feature of the invention, the slots are inclined with respect to the sheet travel direction.

In accordance with a further feature of the invention, the slots are oriented in the sheet travel direction.

In accordance with an added feature of the invention, the slots have a width which varies along the length thereof.

In accordance with an additional feature of the invention, the slots have a variable width.

In accordance with yet another feature of the invention, the slots are respectively disposed repeatedly on both sides of a line of symmetry extending in the sheet travel direction. The line of symmetry has a central location with respect to the sheet-guiding surface.

In accordance with yet a further feature of the invention, the slots are of different lengths.

In accordance with yet an added feature of the invention, the blast-air supply system has chambers respectively communicating with the slots.

In accordance with yet an additional feature of the invention, in a multiple configuration of the slots, the slots are to be acted upon individually with blast air.

In accordance with another feature of the invention, the machine further includes waste-air openings and blowers assigned to the slots and having suction sides communicating with the waste-air openings, and having pressure sides communicating with the slots.

In accordance with a further feature of the invention, the machine further includes throttles or restrictors disposed in the flow ducts.

In accordance with a concomitant feature of the invention, the throttles or restrictors are formed of air-permeable material.

In order to achieve the afore-mentioned object of the invention, provision is made for the sheet-guiding device to have flow ducts which align the sheet-carrying air flows and for the air passage openings in the sheet-guiding surface to have opening cross-sections of the flow ducts in the form of slots having a length which is many times greater than the width thereof.

This advantageously acts upon the behavior of the sheets dragged over the guiding surface inasmuch as sheet-carrying air flows are formed which, upon emerging from the Sheet-guiding surface, extend over the length of the slots transversely with respect to the flow direction and therefore produce a large-volume, homogeneous air cushion.

Other features which are considered as characteristic for the invention are set forth in the appended claims.

Although the invention is illustrated and described herein as embodied in a sheet-processing machine with a pneumatic sheet-guiding device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

In a sheet-processing machine constructed as a sheet-processing rotary printing press, sheet-guiding devices are installed at different locations thereof. A first installation location is in a delivery for combining the processed sheets into a sheet pile or stack. Further installation locations result from assigning sheet guiding devices to transfer devices for transferring the sheets from one printing unit to the next following printing unit or to a sheet reversing or turning station.

Figure 1:
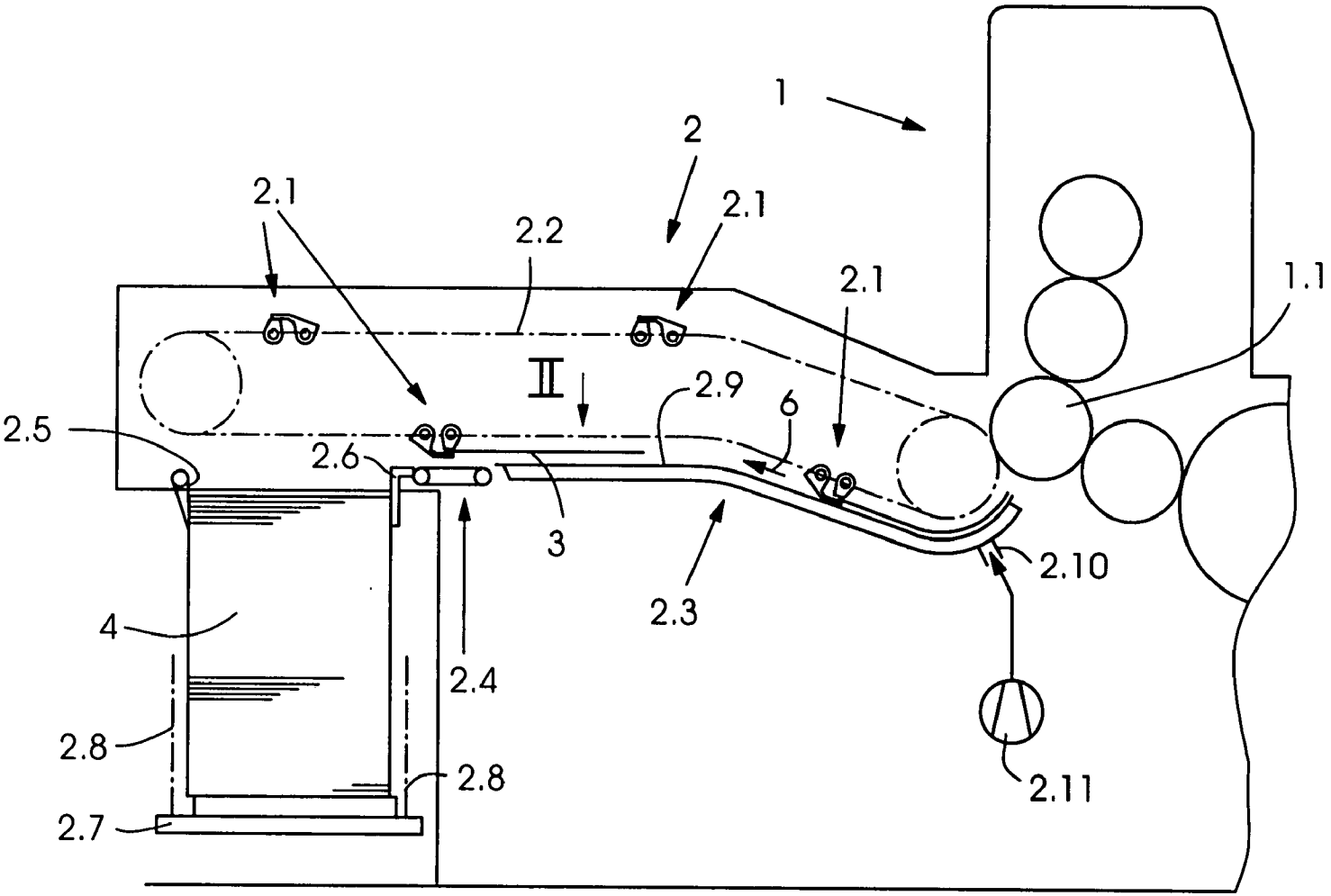
FIG. 1 is a fragmentary, diagrammatic, side-elevational view of a sheet-processing rotary printing press with a pneumatic sheet-guiding device forming a guiding surface, and showing a section including a delivery of the press.

Referring now to the figures of the drawings in detail and first, particularly, to FIG. 1 thereof, there is seen a diagrammatic illustration of a delivery 2 following the last processing unit 1 of a rotary printing press for processing sheets 3. The processing unit 1 is a printing unit or a print aftertreatment unit, such as a varnishing unit, a perforating unit or the like.

The example at hand is a printing unit 1 operating in accordance with the offset process. The delivery 2 following the printing unit 1 includes gripper systems 2.1 carried by a chain conveyor 2.2 which revolves during operation. The chain conveyor 2.2 is represented herein in phantom, i.e., by dot-dash lines. During one revolution of a respective gripper system 2.1, a sheet 3 is picked up thereby from an impression cylinder 1.1 carrying the latter and is dragged in a dragging direction represented by a directional arrow 6, over a pneumatic sheet-guiding device 2.3 to a sheet brake 2.4. The sheet brake 2.4 picks up the sheet 3 as the latter is being released by the gripper system 2.1, brakes it to a depositing speed and, for its part, finally releases it, so that it strikes leading edge stops 2.5 at this depositing speed, while falling at the same time and being aligned on the stops 2.5 and on trailing edge stops 2.6 disposed opposite thereto, as well as on otherwise non-illustrated lateral straight joggers. The sheet 3, together with preceding and/or succeeding sheets 3, forms a sheet pile or stack 4 which is carried by a lifting mechanism that lowers the pile 4 to an extent corresponding to an increase in the height thereof. Of the lifting mechanism, only a platform 2.7 carrying the sheet pile 4 and lifting chains 2.8 carrying the platform and represented in phantom, i.e., by dot dash lines, are reproduced in FIG. 1.

A sheet guiding surface 2.9 formed on the sheet guiding device 2.3 follows the path of the gripper systems 2.1 which are moved thereover. The sheet guiding surface 2.9, in particular, for guiding sheets printed on both sides, is provided with non-illustrated air passage openings for discharging sheet-carrying air flows between the sheet guiding surface 2.9 and the sheets 3 guided thereover. The air passage openings are fed by a blast or blown-air supply system, of which a connecting piece 2.10 provided on the sheet guiding device 2.3 and a blast air supplier 2.11 connected thereto are shown in FIG. 1.

In the case in which sheets 3 printed on a single side thereof leave the impression cylinder 1.1, the sheet-guiding device 2.3 is provided with a gap closable by a smoothing device and otherwise in another manner. In order to close the gap in another manner, in one preferred refinement, recourse is had in particular to the measures disclosed in U.S. Pat. No. 5,730,055.

Figure 2:
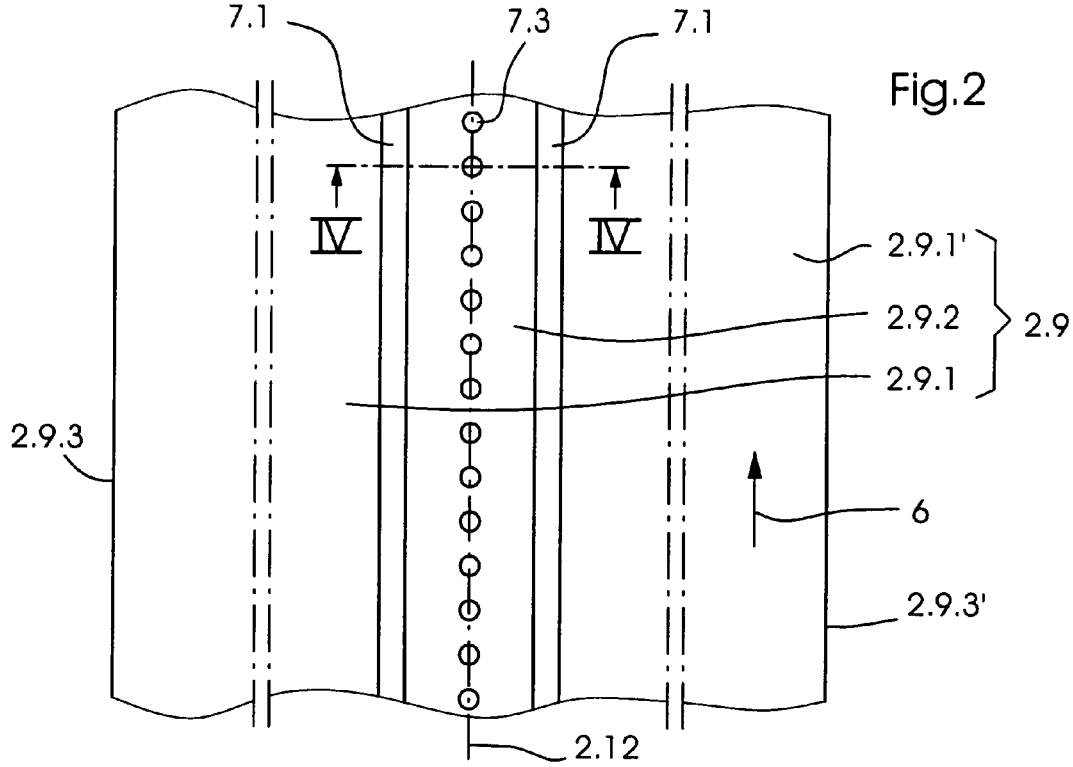
FIG. 2 is an enlarged, fragmentary, top-plan view of a first embodiment of the sheet-guiding device of FIG. 1, as viewed from bottom to top in sheet travel direction.

As can be seen in FIG. 2, the afore-mentioned air passage openings are slots 7.1 having a length which is many times greater than the width thereof. In the sheet guiding surface 2.9, they form opening cross sections of air ducts or flow channels formed in the sheet guiding device 2.3, and serve for guiding the sheet-carrying air flows which are discussed further below in greater detail. In a preferred configuration, these slots 7.1 are disposed symmetrically with respect to a line of symmetry 2.12 extending in the sheet travel direction represented by the directional arrow 6 and disposed centrally of the sheet-guiding surface 2.9.

In the embodiment according to FIG. 2, a respective slot 7.1 is provided on both sides of the line of symmetry 2.12 and extends along the sheet-guiding device 2.3. The sheet guiding surface 2.9 is therewith subdivided into a central section 2.9.2, which encloses the line of symmetry 2.12 and is disposed between the slots 7.1, and respective edge sections 2.9.1 and 2.9.1'. The central section 2.9.2 is preferably very narrow.

Such a restriction to two slots is not peremptory, however. It is also within the scope of the invention, moreover, to provide a greater plurality of slots.

Figure 3:
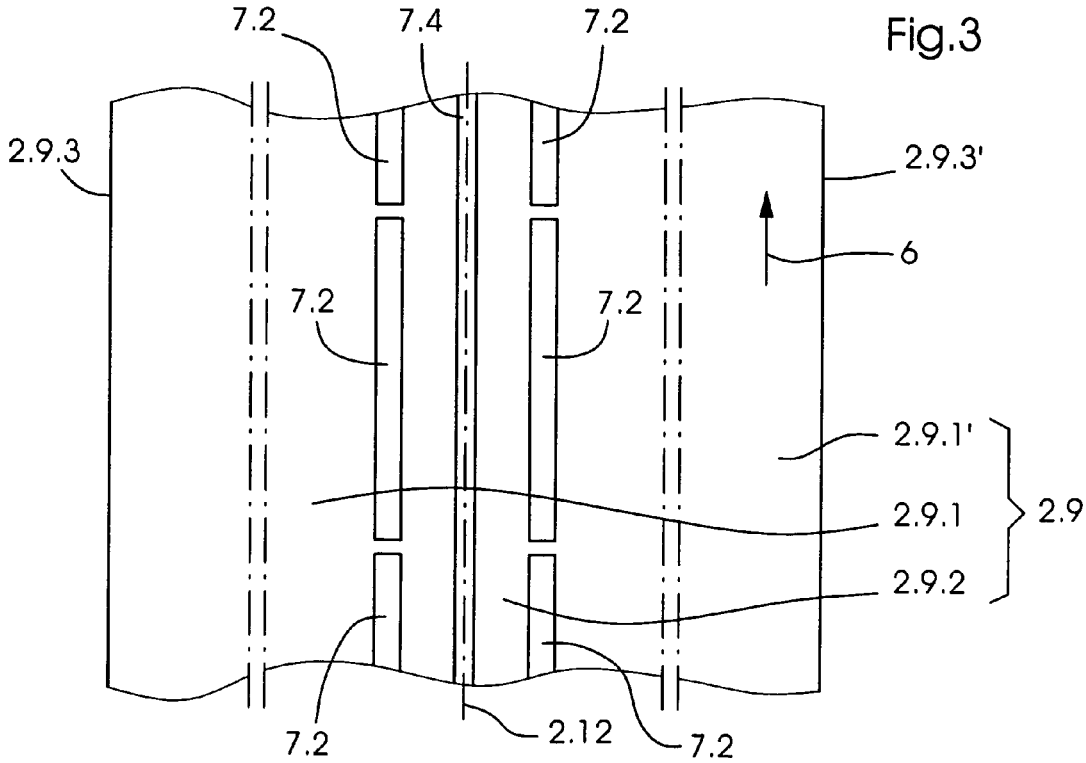
FIG. 3 is a view similar to that of FIG. 2 of a second embodiment of the sheet-guiding device.

Whereas, in the configuration according to FIG. 2, the slots 7.1 extend continuously along the sheet guiding surface 2.9, in the configuration according to FIG. 3, provision is made for a row of slots of which each is formed of a plurality of successive slots 7.2 respectively formed in and along a straight line. In this regard, however, the mutual distance or spacing provided between the slots 7.2 in one and the same row of slots is so small that, during the discharge of sheet-carrying air flows from these slots 7.2, the smallest possible pressure fluctuations are produced in the direction wherein the slots 7.2 extend.

The configuration, respectively, of only one row of slots on a respective side of the line of symmetry 2.12, as shown in FIG. 3, is likewise not peremptory. On the contrary, it is also within the scope of the invention to provide, respectively, a plurality of rows of slots on each side of the line of symmetry 2.12.

Figure 4:
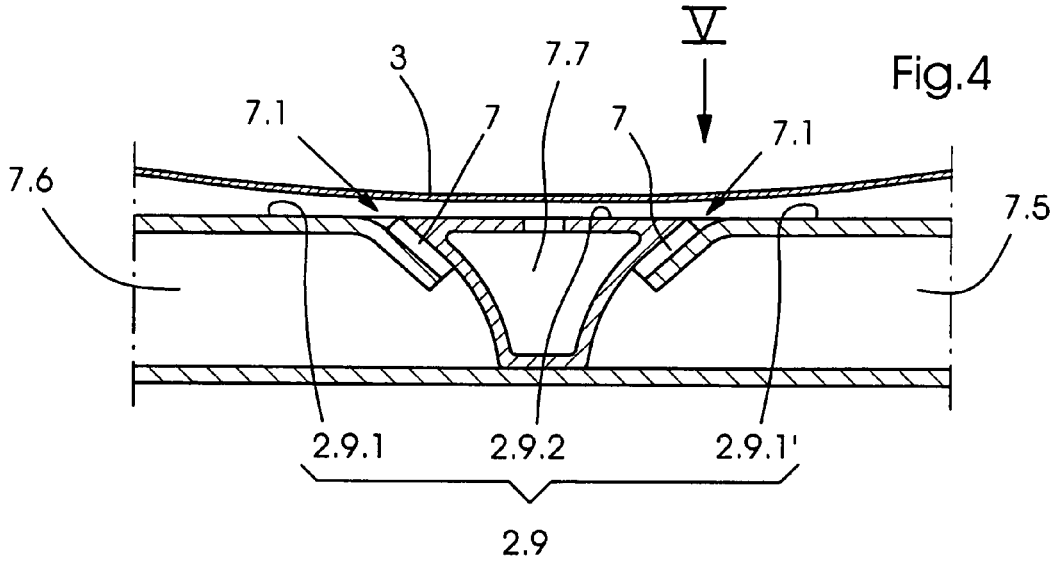
FIG. 4 is an enlarged, cross-sectional view of FIG. 2 taken along a line IV—IV thereof in the direction of the arrows and showing part of a further embodiment of the sheet-guiding device.
Figure 5A:
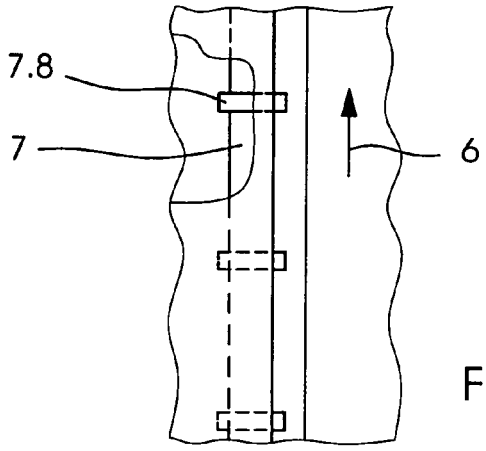
FIG. 5*a* is a fragmentary, top-plan view of FIG. 4 taken in the direction of an arrow V thereof.
Figure 5B:
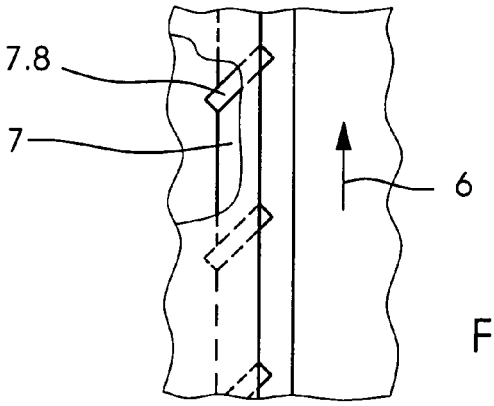
FIG. 5*b* is a view similar to that of FIG. 5*a* of an alternative embodiment of the sheet-guiding device.

As can be seen from FIGS. 4, 5*a* and 5*b*, the sheet-guiding device includes flow ducts or channels 7 which align the sheet-carrying air flows emerging from the slots 7.1 which, for example, are continuous here. The slots 7.2 forming the respective rows of slots according to FIG. 3 likewise have corresponding flow ducts 7 assigned thereto.

In a preferred embodiment, guide vanes 7.8, by which the sheet-carrying air flows are alignable independently of the orientation of the slots 7.1 or 7.2, are inserted into the flow ducts 7.

In a configuration shown in FIG. 5*a*, the guide vanes 7.8 are inserted in a manner that the sheet-carrying air flows emerging from the slots 7.1 on a respective side of the line of symmetry 2.12 during operation are aligned, respectively, perpendicularly to the line of symmetry 2.12.

In a configuration shown in FIG. 5*b* differing from that of FIG. 5*a*, on the other hand, the guide vanes 7.8 are inserted in a manner that the corresponding sheet-carrying air flows, respectively, have flow components extending perpendicularly to the line of symmetry 2.12. In the case of the configuration according to FIG. 5*b*, these flows, moreover, have a flow component extending in the dragging direction represented by the directional arrow 6. However, this orientation is not absolutely necessary. An orientation opposite thereto can also be provided.

According to an exemplary structural configuration illustrated in FIG. 4, the guide plates forming edge sections 2.9.1 and 2.9.1' of the sheet guide surface 2.9 constitute cover plates of respective sheet-carrying air chambers 7.5 and 7.6, which are connected to non-illustrated respective blowers or to a non-illustrated common blower. The central section 2.9.2 of the guide surface 2.9 is formed on a purging air chamber 7.7 which bounds a respective one of the sheet-carrying air chambers 7.5 and 7.6 in the direction of the longitudinal center of the guide surface 2.9, and is described hereinafter in greater detail.

The aforementioned cover plates of the sheet-carrying air chambers 7.5 and 7.6 extend angularly away from the sheet guiding surface 2.9 in the edge region, respectively, thereof facing towards the purging air chamber 7.7, and these angularly extending edge regions are located opposite to a respective lateral longitudinal wall of the purging air chamber 7.7, with spacings from one another which are bridged by the guide vanes 7.8, the alignment of which, as aforementioned, is critical with regard to the angle with respect to the lateral edges 2.9.3 and 2.9.3' at which sheet-carrying air flows emerge from the flow ducts 7 formed in this manner, i.e., from the slots 7.1 or 7.2 (in this regard, note FIGS. 5*a* and 5*b*).

The sheet-carrying air flows emerging from the slots 7.1 and 7.2, respectively, assuming the orientation thereof provided as described, without further measures, give rise to a lower pressure in the region of the central section 2.9.2 of the guiding surface 2.9 than in the regions of the edge sections 2.9.1 and 2.9.1' of the guiding surface 2.9.

As an appropriate, continuing measure, provision is therefore made for the air passage openings mentioned at the introduction hereto not to be exhausted exclusively by a construction involving slots 7.1 and 7.2, respectively, but for some of these air passage openings to be disposed in the region of the central section 2.9.2 of the sheet guiding surface 2.9 and to discharge purging air flows during operation in such a manner that a pressure drop in the region of the central section 2.9.2 is counteracted, which would otherwise be caused by the sheet-carrying air flows emerging from the slots 7.1 and 7.2 in the case of the orientation thereof here provided.

In a first configuration of the air passage openings serving for discharging purging air flows, these openings constitute purging air openings 7.3 in the form of discrete round or polygonal apertures in the guiding surface 2.9 which, in the case of the exemplary embodiment according to FIG. 2, are lined up on the line of symmetry 2.12 and are preferably located at relatively small distances spaced from one another. However, other types of configuration of the purging air openings 7.3 lie within the scope of the invention. Every other type of configuration is preferably selected from the point of view that the smallest possible pressure fluctuations occur in the sheet travel direction according to the directional arrow 6.

A configuration reproduced in FIG. 3 provides, as an example, instead of individual purging air openings, a purging air slot 7.4, which extends in the sheet travel direction and, in the illustrated case, encloses the symmetry line 2.12.

Analogous to the formation of a row of slots formed from the slots 7.2, a corresponding row of purging air slots can also be provided as an alternative to a continuous purging air slot 7.4.

It is also possible, for example, for two purging air slots 7.4 or rows of purging air slots to be provided parallel to the line of symmetry 2.12.

The purging air slot or slots 7.4 and the purging air openings 7.3, respectively, in an exemplary configuration according to FIG. 4, are formed in a chamber wall which, in turn, forms the central section 2.9.2 of the guide surface 2.9 and belongs to the purging air chamber 7.7 mentioned hereinbefore, which permits the purging air slots 7.4 and the purging air openings 7.3 to be connected to a separate air supply system.

In the configuration reproduced by way of example in FIG. 4, the purging air chamber 7.7 forms respective lateral boundary walls of the sheet-carrying air chambers 7.5 and 7.6 and duct walls of the flow ducts or channels 7. In a non-illustrated alternative configuration differing from that of FIG. 4, a common sheet-carrying air chamber supplying the slots 7.1 and 7.2 is provided, and the purging air chamber 7.7 is formed so that it projects into this common sheet-carrying air chamber only to a given extent.

There are no special requirements with respect to the formation of the purging air slot or slots 7.4 and the purging air openings 7.3, respectively, inasmuch as it is sufficient for them to operate as explained hereinbefore, if the flows emerging therefrom are oriented perpendicularly to the guide surface 2.9.

The interaction of the purging air and the sheet-carrying air flows, assuming suitable dimensioning thereof and assuming an orientation of the slots 7.1 and 7.2 corresponding to the configurations according to FIGS. 2, 3, 5*a* and 5*b*, results in a floating behavior of the sheet 3 dragged over the guide surface 2.9 as is represented qualitatively by the cross-sectional course thereof indicated as a start of a wave shape in FIG. 4.

The already hereinafore-mentioned configuration of a plurality of slots 7.1 or a plurality of rows of slots each formed of slots 7.2 on a respective side of the line of symmetry 2.12 is preferably provided in a guiding device which is intended for guiding large-format sheets 3.

Figure 6:
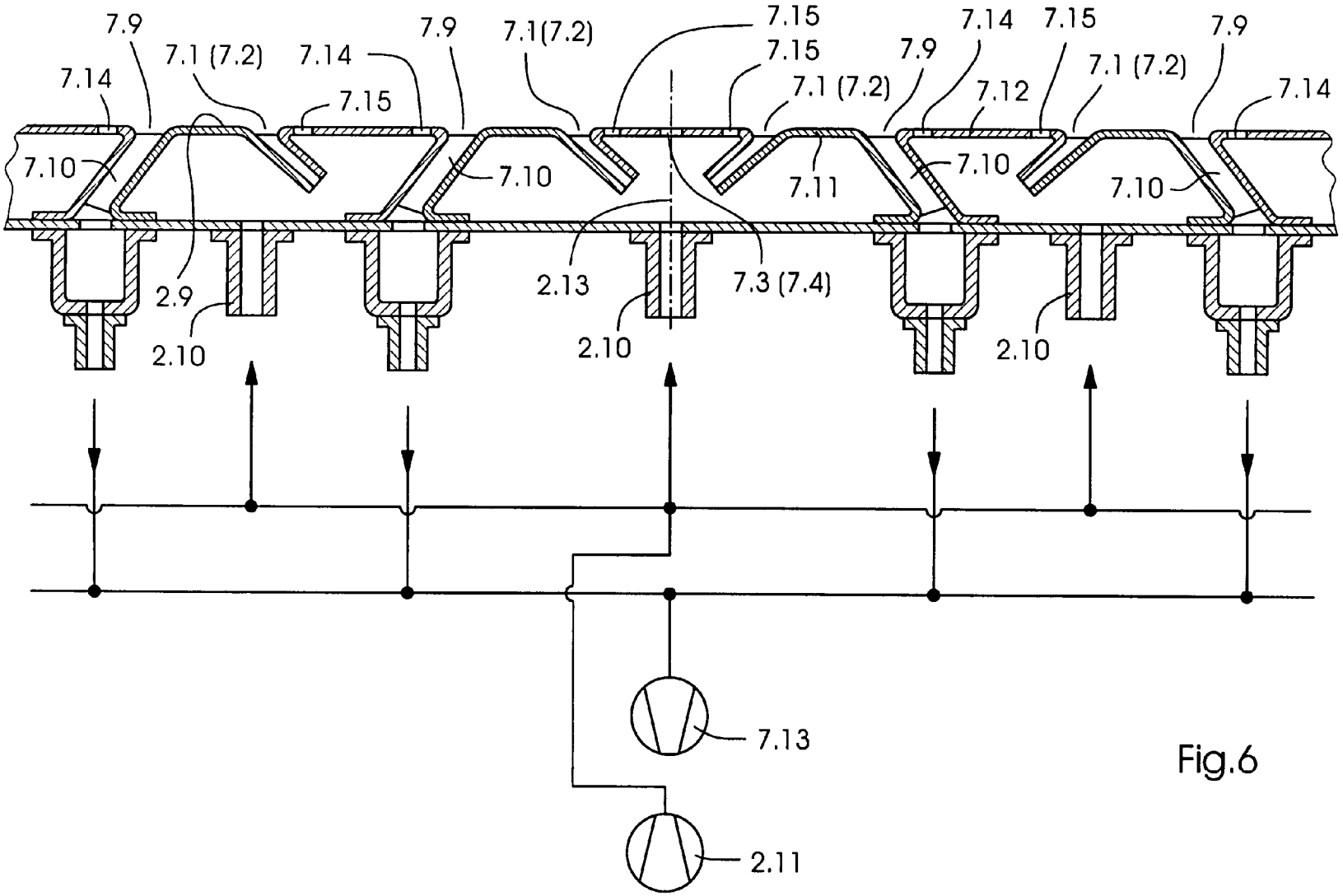
FIG. 6 is a, enlarged, cross-sectional view of FIG. 2 taken along a line IV—IV thereof in the direction of the arrows, showing a section of a sheet-guiding device and further diagrammatically illustrating a blast or blown-air supply system and a pneumatic disposal system.

FIG. 6 illustrates an exemplary embodiment for this purpose wherein, moreover, differing from the configuration according to FIG. 4, the purging air chamber 7.7 or a structurally different embodiment thereof formed as hereinafore-discussed for this purpose is dispensed with and, instead, purging-air and sheet-carrying air flows emerge from a common air chamber, as can also be provided, for example, for the case of a total of only two slots 7.1 or rows of slots formed of slots 7.2.

On the other hand, in the case of a plurality of slots 7.1 and, respectively, a plurality of rows of slots each formed from slots 7.2 on a respective side of the line of symmetry 2.12, separate chambers can also be provided for supplying, on the one hand, the slots 7.1 and the rows of slots, respectively, and, on the other hand, the air passage openings discharging the purging air flows, here, depending upon the configuration, the purging air openings 7.3 and a purging air slot 7.4, respectively.

In the configuration according to FIG. 6, a plurality of slots 7.1 and rows of slots formed of slots 7.2, respectively, with a slot extent respectively corresponding to that in FIGS. 2 and 3, for example, are provided on both sides of a plane of symmetry 2.13, which is perpendicular to the guide surface 2.9 and contains the line of symmetry 2.12.

The air passage openings formed as a whole in the guide surface 2.9 also form waste-air openings 7.9 in the illustrated configuration of FIG. 6, it being possible for the geometry and configuration thereof in principle to be selected in a manner analogous to that of the air passage openings mentioned in this respect.

In the exemplary configuration according to FIG. 6, the waste-air openings 7.9 are preferably formed and disposed in a manner analogous to the rows of slots formed of the slots 7.2 and discharging a sheet-carrying air flow during operation. With respect to the configuration of the waste-air openings 7.9, there is also to be understood, in this regard, an alignment of slots parallel to the aforementioned rows of slots. In this regard, respective waste-air openings 7.9 form a row of slots which are disposed in a straight line, and individual slots of the rows thereof, in each case ending at respective webs 7.10 corresponding to guide vanes 7.8 which, while forming a gap, interconnect angled-over sections of guide plate sections 7.11 and 7.12 forming the guide surface 2.9.

A respective one of the straight lines along which some of the waste-air openings 7.9 are disposed is spaced farther apart from the line of symmetry 2.12 than a respective straight line along which a slot 7.1 and a corresponding row of slots formed of slots 7.2, respectively, discharging a sheet-carrying air flow during operation are disposed so that, starting from the line of symmetry 2.12, on both sides thereof, a respective one of the slots 7.1 provided repeatedly and a respective one of the rows of slots provided repeatedly, respectively, are in each case followed by a straight line parallel to the line of symmetry 2.12 and having waste-air openings 7.9 disposed along the parallel line. The slots 7.1 and 7.2, respectively, on the one hand, and the waste-air openings 7.9, on the other hand, are thus disposed alternatingly. However, for the orientation of the sheet-carrying air flows presented, this alternating configuration is preferably continued only as far as a respective outermost slot 7.1 in a respective edge region of the guide surface 2.9 which ends at the lateral edges 2.9.3 and 2.9.3', in which region the respective slots 7.1 are then no longer followed by any waste-air openings 7.9. The waste-air openings form sinks for the sheet-carrying air flows and, when slots 7.1 and rows of slots, respectively, are provided repeatedly on both sides of the line of symmetry 2.12, prevent a superimposition of sheet-carrying air flows and, to this extent, promote well-defined flow conditions within the air cushion.

The extent of the influence upon these flow conditions can be varied, depending upon the configuration of the sheet guiding device, specifically by the fact that, in a first case, the waste-air openings 7.9 communicate with the atmosphere on a side of the sheet guiding device which faces away from the guiding surface 2.9, while, in a second case, a vacuum generator 7.13 which acts upon the waste-air openings 7.9 is provided (note FIG. 6).

As indicated hereinbefore, without further measures, the sheet-carrying air flows emerging from the respective slots 7.1 and from the rows of slots formed by the slots 7.2, respectively, produce negative pressures in a respective region upstream with respect to the point of emergence, which are countered by purging-air and supporting-air flows within the context of the invention.

As can be seen from FIG. 6, for this purpose, purging air openings 7.14 which discharge purging air flows during operation are formed from some of the air passage openings and, in the respective direction of the flow or direction of a flow component of the sheet-carrying air flows oriented towards a respective lateral edge 2.9.3 or 2.9.3', follow respective waste-air openings 7.9.

With respect to the outflow direction of the sheet-carrying air flows emerging from the slots 7.1 and from the rows of slots formed of the slots 7.2, respectively, regions wherein the aforementioned negative pressures assume a maximum follow the slots 7.1 and rows of slots, respectively, immediately upstream. In these regions, there are preferably disposed supporting-air openings 7.15 provided for the discharge of supporting-air flows during operation.

For the configuration and the configuration of the purging-air openings 7.14 and the supporting-air openings 7.15, recourse may preferably be had to the statements made at an earlier point relating to the purging-air openings 7.3 and purging-air slots 7.4 disposed in the central section 2.9.2.

In configurations alternative to FIG. 6, in order to supply the slots 7.1 and rows of slots, respectively, discharging the sheet-carrying air flows, the purging-air openings 7.14 and the supporting-air openings 7.15, respectively, separately or, to some extent, also common air chambers and a respectively adapted installation of the blast or blown air supply are provided. In the special case of recto printing operation of the press, all the air passage openings communicate with one vacuum generator 7.13, so that the sheets 3 are dragged over the guiding surface 2.9 while maintaining smooth contact therewith.

As can further be seen in FIG. 6, the blast or blown air supply system has chambers 7.18, 7.19 which communicate with respective slots 7.1 and 7.2. This provides the possibility of applying blast or blown air individually to a plurality of slots 7.1 and 7.2 disposed on a respective side of the plane of symmetry 2.13.

Figure 7:
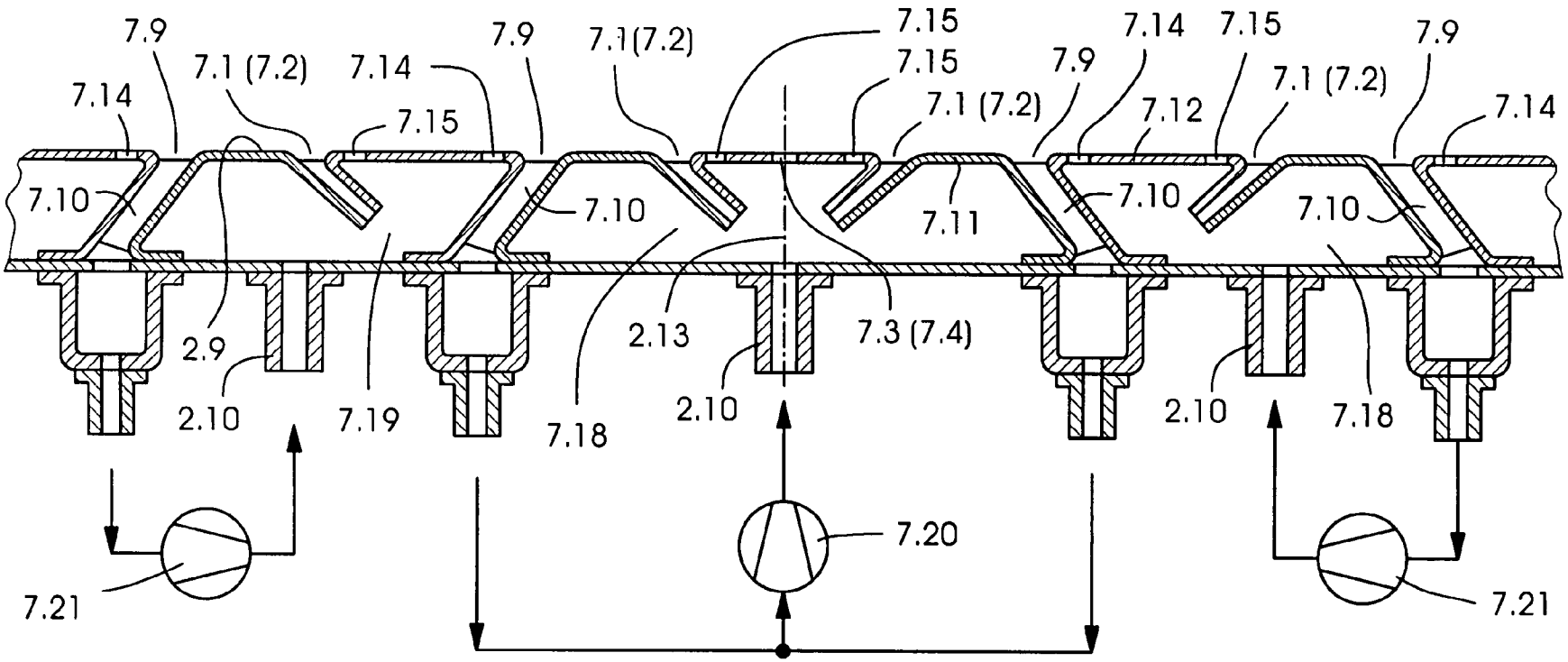
FIG. 7 is a view similar to that of FIG. 6, showing the sheet-guiding device having a blast or blowing-air supply differing from that of FIG. 6.

In FIG. 7, there is shown a blast or blown air supply system constructed for this purpose, which, moreover, advantageously provides the possibility of creating circulatory loops of the sheet-carrying air flows expelled from the sheet guiding surface 2.9 and air extracted from the air cushion via the waste-air openings 7.9. For this purpose, blowers 7.20 and 7.21 are provided, the suction sides of the blowers 7.20 and 7.21 communicating with the waste-air openings 7.9, and the pressure sides of the blowers 7.20 and 7.21 communicating with the slots 7.1 and 7.2.

Figure 8:
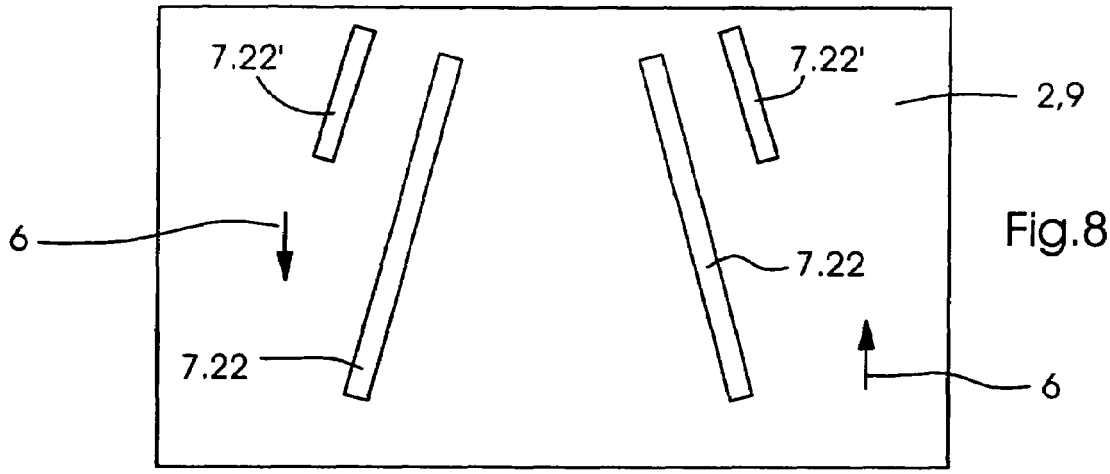
FIG. 8 is a view similar to those of FIGS. 2 and 3 of a sheet-guiding device which, however, has an orientation of slots differing from those of FIGS. 2 and 3 for expelling sheet-carrying air flows.
Figure 9:
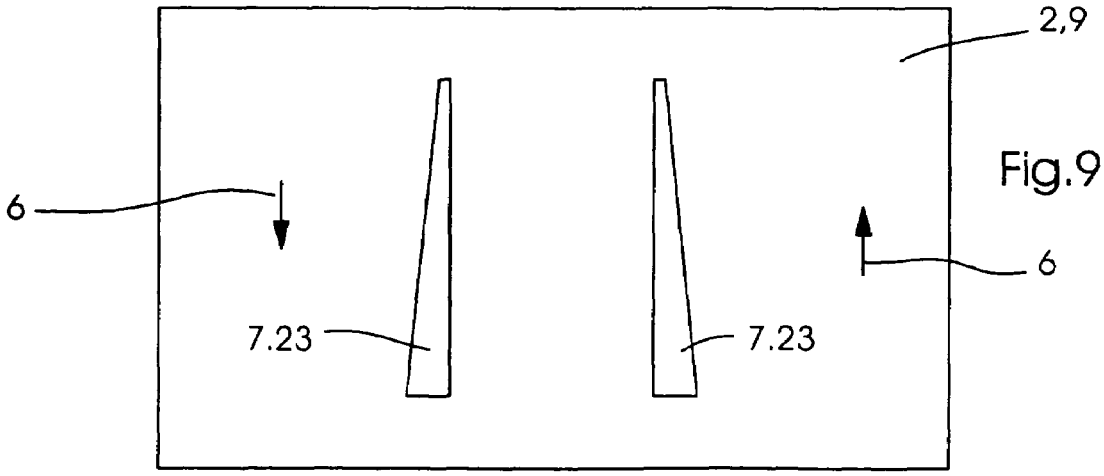
FIG. 9 is a view similar to that of FIG. 8, showing a sheet-guiding device having a geometry of slots differing from those of FIGS. 2, 3 and 8 for expelling sheet-carrying air flows.
Figure 10:
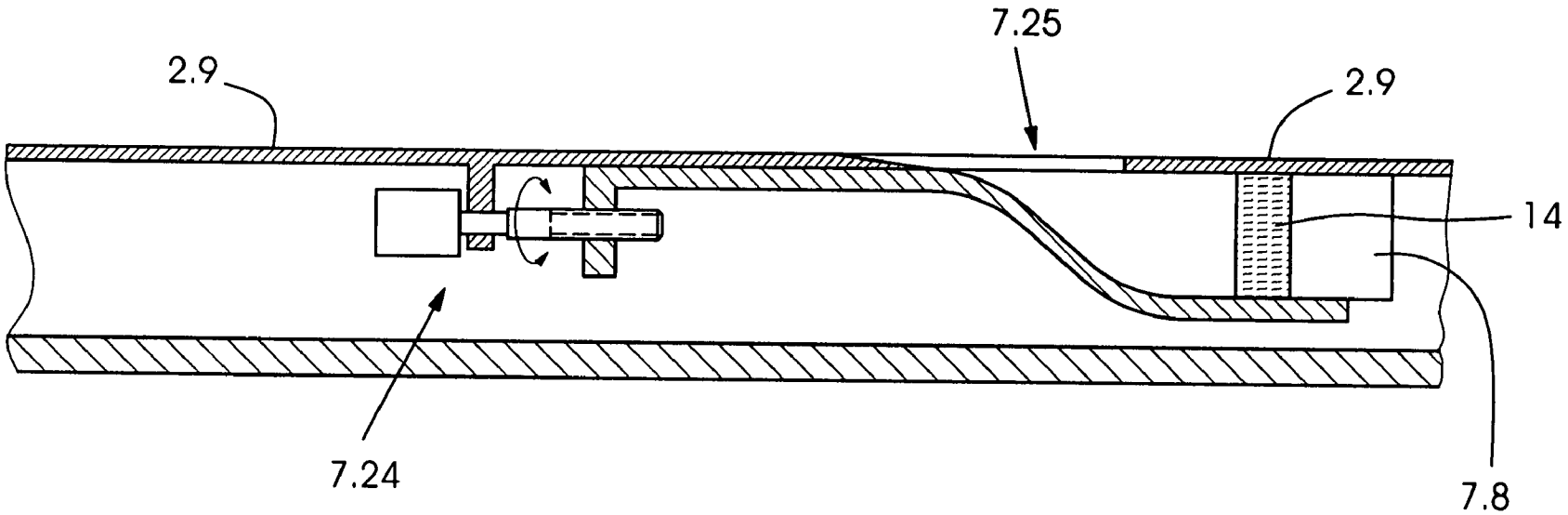
FIG. 10 is an enlarged, fragmentary sectional view of FIG. 1 showing the sheet-guiding device having a slot of variable width for expelling a sheet-carrying air flow in a section taken transversely to the longitudinal extent of the slot.

As indicated in FIGS. 8 to 10, the construction of the flow ducts 7 is not restricted to the case wherein the opening cross-sections thereof in the sheet guiding surface 2.9 form slots 7.1 and 7.2, respectively, oriented in the sheet travel direction in accordance with directional arrow 6, according to the illustration in FIGS. 2 and 3, the slots 7.1 and 7.2 also having fixedly predefined and constant slot widths. Instead, in alternative configurations of corresponding flow ducts, the opening cross-sections thereof in the sheet-guiding surface 2.9 also have alignments and slot forms differing from those of FIGS. 2 and 3.

Two different embodiments of alternative configurations are indicated in FIG. 8, to which a configuration of slots 7.22 and 7.22' discharging sheet-carrying air and inclined with respect to the sheet travel direction is common. In a first one of these different embodiments, the slots 7.22 and 7.22' diverge in the sheet travel direction while, in a second one of the embodiments, the slots 7.22 and 7.22' converge in the sheet travel direction. In FIG. 8, this is indicated by the opposite orientation of the directional arrows 6 indicating the sheet travel direction.

This applies in an analogous manner to the directional arrows 6 in FIG. 9, so that this again indicates two different embodiments. Here, a first one of these different embodiments exhibits slots 7.23 broadened in the sheet travel direction, and the other of the different embodiments has slots 7.23 broadened counter to the sheet travel direction. Overall, in this case, the width of the slots 7.23 varies along the length thereof.

Configurations according to FIGS. 8 and 9 prove to be particularly advantageous in the case of a sheet-guiding surface 2.9 which is curved in the sheet travel direction or a correspondingly curved section thereof. In particular in this case, a configuration has proven to be advantageous as well wherein the opening cross-sections of the flow ducts 7 form width-varying slots in the sheet-guiding surface.

FIG. 10 shows a corresponding configuration in a sectional illustration, having a diagrammatically illustrated actuating device in the form of a spindle drive 7.24 for adjusting the width of a slot 7.25, which is here oriented in the sheet travel direction by way of example. Disposed in each flow duct is air-permeable material serving as a restrictor or throttle 14 for evening or smoothing out the air which is flowing out and for reinforcing the sheet supporting force.

As mentioned hereinbefore, pneumatic sheet guiding devices of the type discussed to this extent, in particular in sheet-processing rotary presses, are also advantageously assigned to transfer devices which transfer the sheets from one to a next printing unit or to a reversing or turning station.

Figure 11:
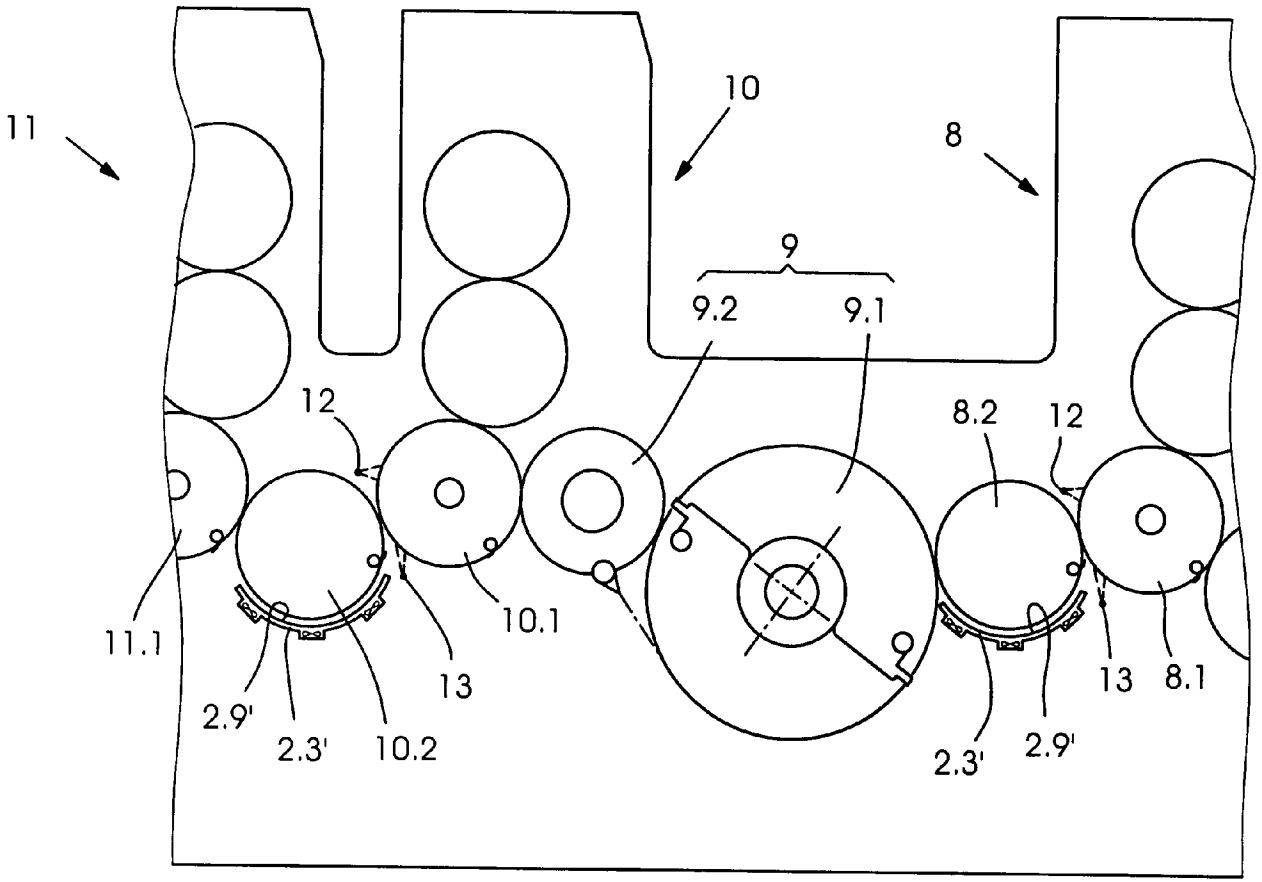
FIG. 11 is a fragmentary, side-elevational view of a rotary printing press including a reversing or turning station, respective printing units preceding and following the reversing station, with respective transfer devices disposed downstream from respective impression cylinders of the printing units, and respective sheet guiding devices being assigned to the transfer devices.

Applications of this type are diagrammatically illustrated in FIG. 11. As shown by way of example, an impression cylinder 8.1 of an offset printing unit 8 is followed by a transfer device 8.2. The latter takes over the sheets 3 from the impression cylinder 8.1 and transfers them to a storage drum 9.1 provided in a reversing or turning station 9, from which a reversing or turning drum 9.2 belonging to the reversing or turning station 9 takes over the sheets 3 and transfers the previously trailing ends of the sheets 3 to an impression cylinder 10.1 of a following printing unit 10. A further transfer device 10.2 then takes over the sheets 3 from the impression cylinder 10.1 and transfers them to an impression cylinder 11.1 of a further following printing unit 11.

The transfer devices 8.2 and 10.2 have a sheet-guiding device 2.3' assigned thereto, which forms a sheet guiding surface 2.9' curved concavely in the sheet travel direction and, incidentally, has one of the configurations described, in this respect, with regard to ducts for aligning sheet-carrying air, the opening cross-sections of the ducts in the sheet-guiding surface 2.9' in the form of slots and their configuration, number and shaping; just as in the case of the sheet guiding device 2.3 according to FIG. 1, in the case of a plurality of slots provided on both sides of the line of symmetry 2.12, i.e., at least two on each side, these also possibly having different lengths, as indicated by way of example in FIG. 8.

Sheet-guiding devices of the configurations described, in this respect, in sheet-processing rotary presses in practice in particular follow a respective impression cylinder, which in principle is followed by a revolving sheet-acceptance device, whether it is in the form of the aforementioned chain conveyor 2.2 or the aforementioned transfer devices 8.2 and 10.2. For transferring the sheets 3 to the sheet-acceptance device in a manner appropriate for the process, however, it proves to be advantageous to peel the sheets off the respective impression cylinder. In a preferred configuration of the machine, this is performed by blast or blower devices.

Blast or blower devices 12 and 13 which are suitably constructed and disposed for this purpose are indicated diagrammatically in FIG. 11. A suitable construction is, for example, in the form of pipes which are closed at the end and connected to a positive pressure generator, such as a blower, and along which outflow openings or blower nozzles are provided. For a suitable configuration, the blower device 12 bends or bows a respective sheet 3 in the region of the enveloping lines of the impression cylinder 8.1 and 10.1, respectively, the lines being upstream of the transfer center line, i.e., the connecting line between the axes of rotation of the impression cylinder 8.1 and the transfer device 8.2, on the one hand, and the impression cylinder 10.1 and the transfer device 10.2, on the other hand, respectively, towards the impression cylinder 8.1 and 10.1, and the blower device 13 blows under the sheet accepted from the transfer devices 8.2 and 10.2, respectively, in the region of the exit pocket between the impression cylinders 8.1 and 10.1, respectively, and the transfer devices 8.2 and 10.2, respectively.

We claim:

1. A sheet-processing machine, comprising:

a blast or blown-air supply system; and a pneumatic sheet-guiding device connected to said blast or blown-air supply system;

said sheet-guiding device having flow ducts for aligning sheet-carrying air flows, said flow ducts having side-walls, said flow ducts having guide vanes and throttles or restrictors disposed therein, said guide vanes being oriented orthogonally or at an angle with respect to said side walls;

said sheet-guiding device having a sheet-guiding surface;

said sheet-guiding surface having air passage openings formed therein for sheets being dragged over said air passage openings in a sheet travel direction and for expelling said sheet-carrying air flows during operation;

said air passage openings in said sheet-guiding surface forming opening cross-sections of said flow ducts, said opening cross-sections being slots having a length and a width, said length being multiple times greater than said width.

2. The machine according to claim 1, wherein said slots are disposed symmetrically with respect to a line of symmetry.

3. The machine according to claim 1, wherein said air passage openings include waste-air openings assigned to said slots.

4. The machine according to claim 3, wherein said waste-air openings are waste-air slots.

5. The machine according to claim 3, wherein said waste-air openings, on a side of said sheet-guiding device facing away from said sheet-guiding surface, are in communication with the atmosphere.

6. The machine according to claim 3, further comprising a vacuum generator for acting upon said waste-air openings.

7. The machine according to claim 1, wherein said slots are inclined with respect to said sheet travel direction.

8. The machine according to claim 1, wherein said slots are oriented in said sheet travel direction.

9. The machine according to claim 1, wherein said slots have a width varying along the length thereof.

10. The machine according to claim 1, wherein said slots have a variable width.

11. The machine according to claim 1, wherein said slots are respectively disposed repeatedly on both sides of a line of symmetry extending in said sheet travel direction, said line of symmetry having a central location with respect to said sheet guiding surface.

12. The machine according to claim 11, wherein said slots have different lengths.

13. The machine according to claim 1, wherein said blast-air supply system has chambers respectively communicating with said slots.

14. The machine according to claim 1, further comprising a multiple configuration of said slots to be acted upon individually with blast air.

15. The machine according to claim 1, further comprising waste-air openings and blowers assigned to said slots and having suction sides communicating with said waste-sit openings and pressure sides communicating with said slots.

16. The machine according to claim 1, wherein said throttles or restrictors are formed of air-permeable material.

* * * * *